United States Patent [19]

Weiss et al.

[11] 4,386,741

[45] Jun. 7, 1983

[54] APPARATUS FOR THE MULTIPLE UNWINDING OF WEBS

[75] Inventors: Peter Weiss; Georg Schaffner, both of Neuss, Fed. Rep. of Germany

[73] Assignee: Jagenberg Werke AG, Dusseldorf, Fed. Rep. of Germany

[21] Appl. No.: 200,243

[22] Filed: Oct. 24, 1980

[30] Foreign Application Priority Data

Nov. 2, 1979 [DE] Fed. Rep. of Germany ..... 2944265

[51] Int. Cl.[3] ..... B65H 19/04; B65H 19/12

[52] U.S. Cl. ..... 242/58.6

[58] Field of Search ..... 242/58.6, 58, 79, 80

[56] References Cited

U.S. PATENT DOCUMENTS 2,599,720 6/1952 Prevost ..... 242/58.6
3,345,014 10/1967 Shearn ..... 242/79
3,351,299 11/1967 Fehr ..... 242/79
3,567,151 3/1971 Williams ..... 242/79
3,695,539 10/1972 Lindstaedt ..... 242/58.6

*Primary Examiner*—John M. Jillions
*Attorney, Agent, or Firm*—Sprung, Horn, Kramer & Woods

[57] ABSTRACT

An apparatus for the unwinding of multiple webs which comprises an unwinding stand with bearing brackets for a plurality of web rolls and, preceding said stand, a storage medium for a plurality of web rolls, wherein the storage medium is preceded by an aligning apparatus which aligns each web roll with respect to its axial and angular positions and transfers it to a conveyor of the storage medium which carries it to the unwinding stand. The conveyor is provided with a plurality of holding cribs that are spaced apart the same distance as the bearing brackets and hold the web rolls transferred to them in their aligned position.

5 Claims, 3 Drawing Figures

APPARATUS FOR THE MULTIPLE UNWINDING OF WEBS

BACKGROUND OF THE INVENTION

The present invention relates to an apparatus for the multiple unwinding of webs which comprises an unwinding stand with bearing brackets for a plurality of web rolls and, preceding said stand, a storage medium for a plurality of web rolls.

In an apparatus of this type, reloading of the unwinding stand with web rolls is a rather complicated operation. The individual web rolls must be manually aligned axially and angularly just before they are placed in the unwinding stand. This requires considerable physical effort on the part of the operator since the web rolls are heavy. A further drawback is that reloading entails an interruption of operation for an appreciable length of time.

SUMMARY OF THE INVENTION

The invention has as its object to provide an apparatus of the type mentioned above which permits the unwinding stand to be reloaded with web rolls faster and effortlessly so far as the operator is concerned.

In accordance with the invention, this object is accomplished in that the storage medium is preceded by an aligning apparatus which aligns the individual web rolls with respect to their axial and angular positions and transfers them one by one to a conveying means of the storage medium which carries them to the unwinding stand and comprises a plurality of holding cribs arranged in a row in conformity with the spacing between the bearing brackets of the unwinding stand, the transferred web rolls being held aligned in said holding cribs.

With the invention, the new web rolls are aligned and spaced apart on the storage medium by the distance separating the bearing brackets in the unwinding stand as the rolls located in that stand are being unwound, and the unwinding stand can therefore be reloaded in a minimum of time and without any physical effort on the part of the operator.

The simplest way of securing angular alignment of the individual web rolls is to provide the aligning apparatus with a receiving trough for the web roll. Axial alignment can be obtained in a simple manner by means of an aligning apparatus comprising a conveying means moving in the axial direction of the web roll and whose drive is controlled through a sensor-actuated control device in such a way that as a function of the path of displacement of the web roll between two sensors responsive to its ends the drive is stopped when the web roll is centered. Specifically, the drive may be a stepper motor whose steps are monitored by a counter of the control device in such a way that when one of the sensors delivers a signal the steps are counted until a signal is delivered by the other sensor, the drive then moving the roll back by one-half the displacement path between the two sensors.

An intermediate storage medium for a plurality of web rolls is preferably disposed adjacent to one end of the aligning apparatus. In this embodiment of the invention, the web rolls held on the intermediate storage medium can be aligned and the storage medium loaded even as the unwinding stand is being loaded with the web rolls from the storage medium of the aligning apparatus without there being any need for bringing up new rolls from the outside and loading them into the aligning apparatus.

A simple and compact design of the intermediate storage medium is obtained when the latter comprises a turntable for rotating the web roll at right angles to its longitudinal axis and, adjacent thereto, a conveying means extending alongside the storage medium.

Suited for use as conveying means for both the storage medium and the intermediate storage medium as well as for the aligning apparatus are conveyor belts.

BRIEF DESCRIPTION OF THE DRAWINGS

The invention will now be described in greater detail with reference to the accompanying drawing illustrating an embodiment thereof, wherein.

DETAILED DESCRIPTION OF THE INVENTION

Figure 1:
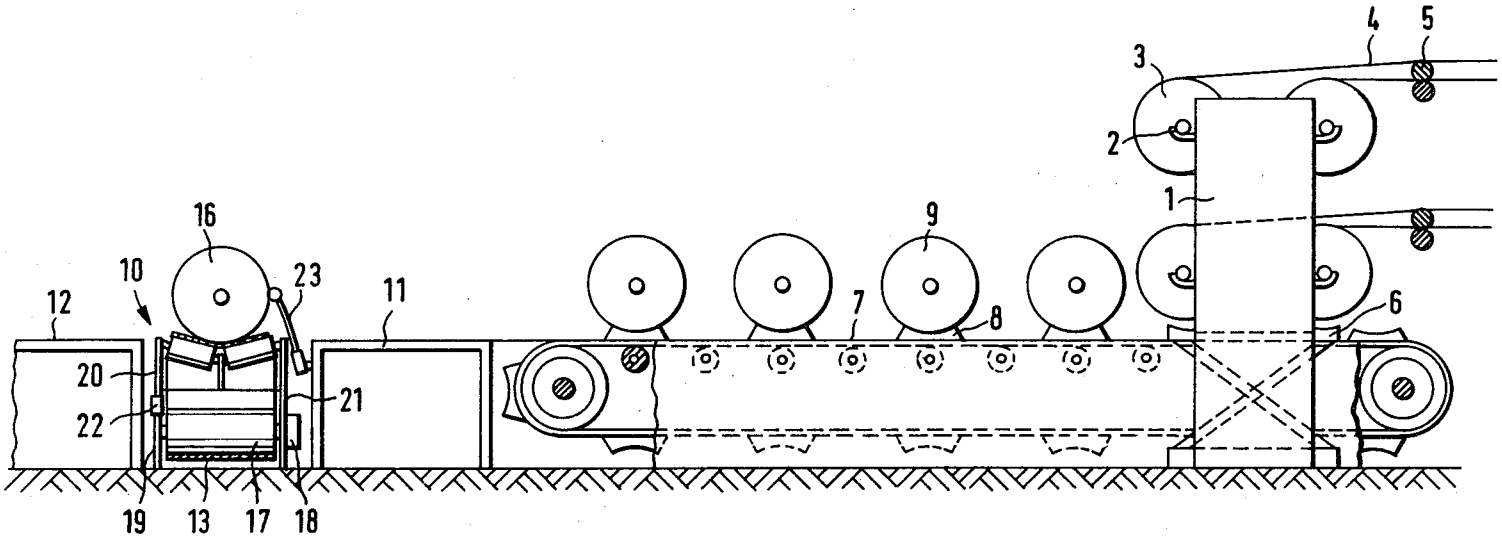
FIG. 1 is a side elevation of an apparatus for the multiple unwinding of webs which comprises a storage medium and an aligning apparatus, taken along the line I—I in FIG. 2.

The apparatus shown in FIG. 1 comprises a stand 1 having a plurality of bearing brackets 2, disposed side by side and on top of one another, each holding a web roll 3. There may be more than one of these stands in a row, or the stand may comprise more than the four bearing brackets 2 shown. The webs 4 are unwound simultaneously from the web rolls, which are rotatably supported on the bearing brackets 2, and led over guide pulleys 5 to be subsequently combined.

For the reloading of the stand 1 with web rolls, a scissors table 6 is provided which raises a plurality of web rolls at one time to the level of the brackets 2. The web rolls for reloading the stand 1 are brought up on an endless conveyor belt 7 which passes around a pulley located behind the stand and is provided with holding cribs 8 that are spaced apart the same distance as the bearing brackets 2 and are of such construction that they fix the individual web rolls 9 in their axial and angular positions as they are being moved. In the area of the stand 1, the conveyor belt 7 passes through the scissors table 6, which is of two-part construction. The belt is of such width that the ends of the web rolls 9 project beyond its sides. Thus the two-part scissors table 6 is able to pick up the web rolls 9 by its receiving cradles, which are spaced apart the same distance as the holding cribs and the bearing brackets. Of course, it is also possible to slit the conveyor belt down the middle and locate the scissors table 6 midway between the two sections of the conveyor belt 7.

Figure 3:
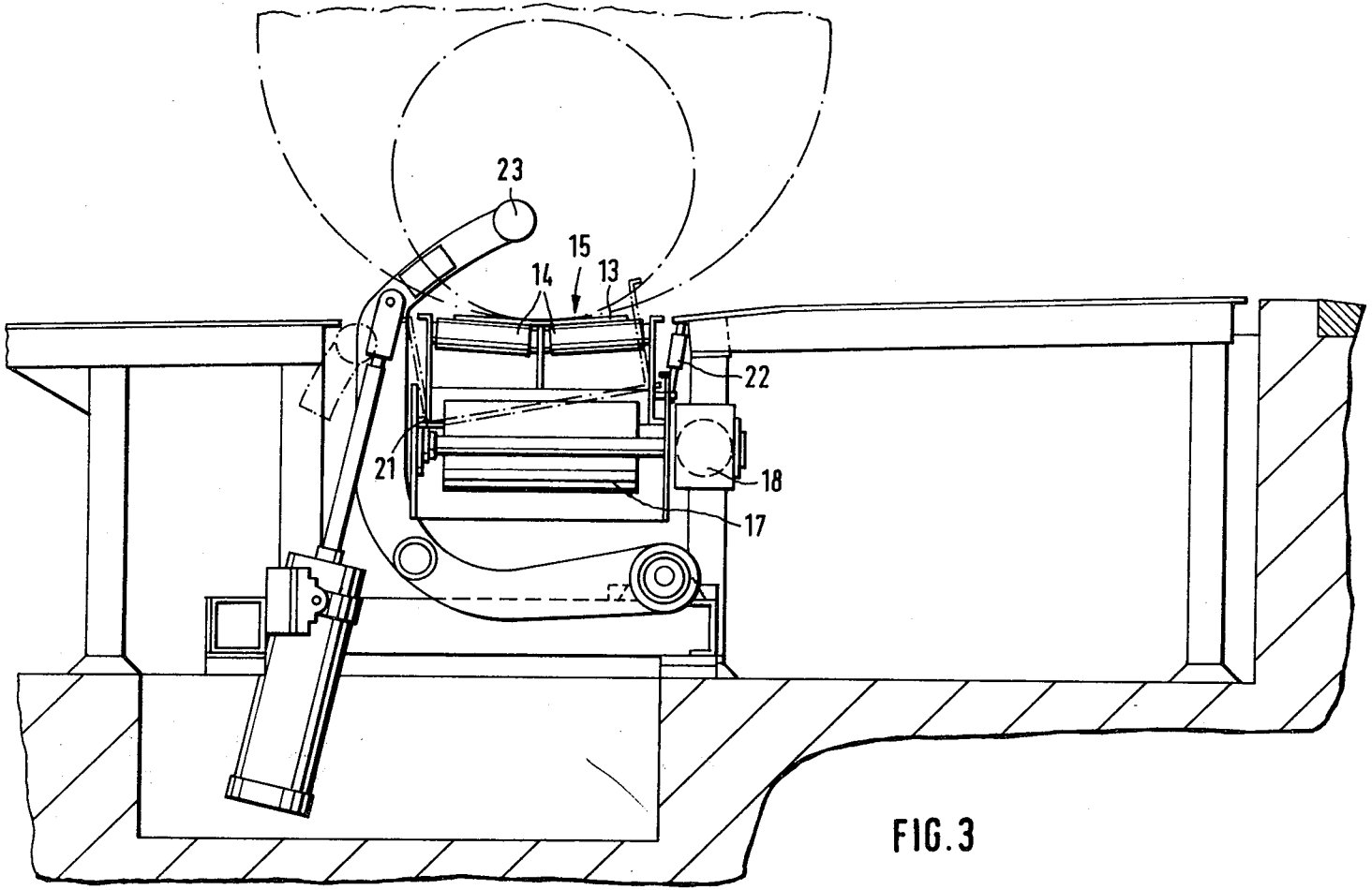
FIG. 3 is a side elevation of the aligning apparatus on an enlarged scale.

The conveyor belt 7 is preceded by an aligning apparatus 10. As is apparent from the embodiment shown in FIGS. 1 and 3, a discharge ramp 11 may be disposed between the start of the conveyor belt 7 and the aligning apparatus 10. An infeed ramp 12 precedes the aligning apparatus 10. The latter comprises a conveyor belt 13 moving at right angles to the direction of travel of the conveyor belt 7. Belt 13 is supported on rolls of two-part construction which are disposed so as to form a receiving trough 15 for the web roll 16 to be aligned. Conveyor belt 13 further passes over a drive roll 17 which is driven by a stepper motor 18. The drive roll 17, along with guide and idler rolls which are not shown, is mounted in the lower part 19 of a frame in whose upper part the two-part rolls 14 are supported. The upper part 20 of the frame is adapted to be tilted on a fulcrum 21 by means of a lifting element 22 for the transfer of a web roll 16 located in the receiving trough 15 to the discharge ramp 11.

To prevent a web roll rolling from the infeed ramp 12 into the aligning apparatus from rolling over the aligning apparatus 10, a retractable, resiliently mounted stop 23 may be disposed in front of the discharge ramp 11.

Figure 2:
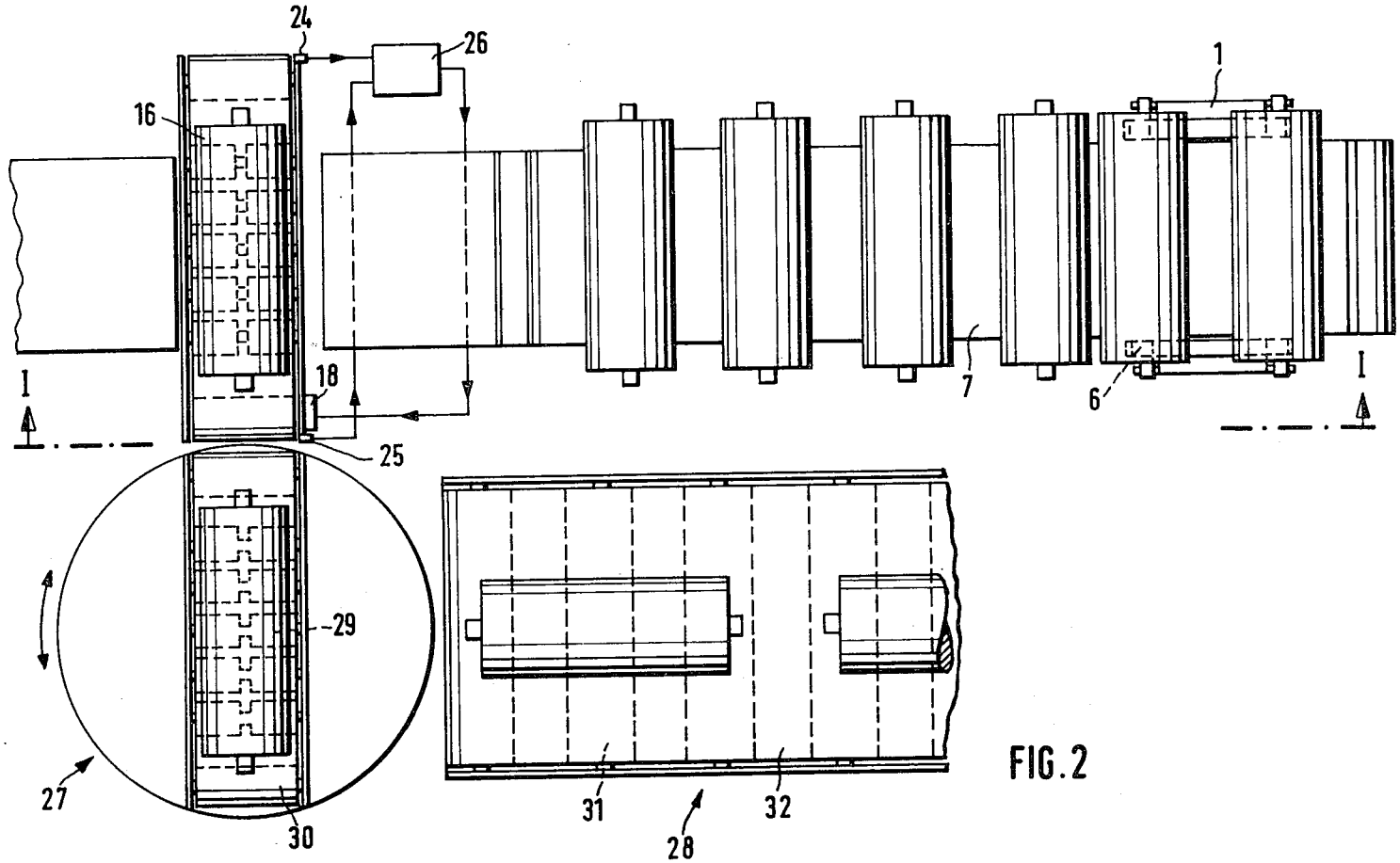
FIG. 2 is a top plan view of the apparatus according to FIG. 1.

Referring now to FIG. 2, the aligning apparatus 10 is provided at both ends of the conveyor belt 13 with a sensor 24 and 25, respectively, which is responsive to the ends of the web roll 16 to be aligned and delivers a signal to a control device 26. The latter comprises a counter and a computer. Axial alignment is secured through this control device 26 in that the stepper motor 18 first moves the web roll 16 to be aligned toward one side, for example, the side with the sensor 24. When the end of the web roll 16 reaches the area monitored by the sensor 24, the latter delivers to the control device 26 a command that triggers the reversal of the stepper motor 18 and actuates the counter for the steps of the stepper motor 18. As soon as the other end of the web roll 16 reaches the area monitored by the sensor 25, the latter delivers a command which interrupts counting by the counter and causes the stepper motor 18 to reverse. The number of steps corresponding to the path of displacement of the web roll 16 between the two sensors 24 and 25 is halved, and a command to move is applied to the stepper motor 18 until this halved number of steps is reached, the web roll 16 being thus centered relative to the unwinding stand 1. By tilting the upper part 20 of the frame, the web roll 16 which has thus been aligned angularly and axially can now be transferred across the discharge ramp 11 to the conveyor belt 7, which then carries it aligned to the stand 1.

Adjacent to one end of the aligning apparatus 10 is an intermediate storage medium comprising a turntable 27 for rotating the web roll at right angles to its longitudinal axis, and a conveying means 28 extending alongside the storage medium. The turntable 27 is constructed in a manner similar to the aligning apparatus 10, that is to say, it comprises a driven conveyor belt 30 supported on rolls 29 of two-part construction. The adjacent conveying means 28 consists of a driven conveyor belt 32 which extends alongside the conveyor belt 7 and is supported on rolls 31.

When the conveyor belt 7, which serves as a storage medium, has been loaded with web rolls, the aligning apparatus 10 feeds the next incoming web roll 16 to the turntable 27, which rotates it 90 degrees and then transfers it to the conveying means 28. The next web roll, too, is transferred to the conveying means 28; but the web roll following it is retained on the turntable 27 and the last web roll is held in the aligning apparatus 10. While no alignment of the web roll transferred to the intermediate storage medium 27 and 28 takes place, the web roll 16 held in the aligning apparatus 10 can be aligned and thus can be loaded onto the storage medium as soon as the latter has been unloaded. The web rolls located on the intermediate storage medium are then successively aligned in the aligning apparatus 10 in the manner described and transferred to the storage medium.

It will be appreciated that the instant specification and claims are set forth by way of illustration and not of limitation, and that various changes and modifications may be made without departing from the spirit and scope of the present invention.

What is claimed is:

1. In an apparatus for the unwinding of multiple webs of the type having an unwinding stand with spaced apart bearing brackets for a plurality of web rolls and means for storing a plurality of web rolls upstream of the stand, the improvement comprising aligning means upstream of the storing means for aligning each web roll to be stored with respect to its axial and angular positions, wherein the storing means comprises first conveying means for transferring webs rolls aligned by the aligning means to the unwinding stand including a plurality of holding cribs, wherein the holding cribs are spaced apart the same distance as the bearing brackets and hold the web rolls transferred to them in their aligned position and wherein the aligning means comprises second conveying means movable perpendicular to the first conveying means and thereby in the axial direction of the web roll to be aligned, and drive control means including a sensor-actuated control device and two spaced apart sensors for moving the second conveying means as a function of the path of displacement of the web roll between the two sensors responsive to the ends of the web roll and stopping the second conveying means when the web roll is in the centered position.

2. The apparatus according to claim 1, wherein the aligning means comprises a receiving trough for a web roll.

3. The apparatus according to claim 1, further comprising intermediate means for storing a plurality of web rolls, disposed adjacent to one end of the aligning means.

4. The apparatus according to claim 3, wherein the intermediate storing means comprises a turntable for rotating the web roll at right angles to its longitudinal axis, and, adjacent thereto, additional conveying means extending alongside the first conveying means.

5. The apparatus according to claim 4, wherein the first and additional conveying means comprise conveyor belts.

* * * * *